US006427261B1

(12) United States Patent
Chadbourn

(10) Patent No.: US 6,427,261 B1
(45) Date of Patent: Aug. 6, 2002

(54) FURNITURE DEVICES AND METHODS

(76) Inventor: David Chadbourn, c/o Native Woods, Inc., 2917 E. 25$^{th}$ St., Minneapolis, MN (US) 55406

( * ) Notice: Subject to any disclaimer, the term of this patent is extended or adjusted under 35 U.S.C. 154(b) by 0 days.

(21) Appl. No.: 09/573,837

(22) Filed: May 18, 2000

Related U.S. Application Data

(60) Provisional application No. 60/134,720, filed on May 18, 1999, and provisional application No. 60/147,305, filed on Aug. 5, 1999.

(51) Int. Cl.$^{7}$ ..... A47C 17/17

(52) U.S. Cl. ..... 5/18.1; 5/37.1

(58) Field of Search ..... 5/18.1, 37.1, 41, 5/47; 297/354.13

(56) References Cited

U.S. PATENT DOCUMENTS

| | | | | | |
|---|---|---|---|---|---|
| 53,188 | A | * | 3/1866 | Rose | 5/18.1 |
| 124,265 | A | * | 3/1872 | Graves | 5/18.1 |
| RE5,275 | E | * | 2/1873 | Caro | 5/18.1 X |
| RE9,099 | E | * | 2/1880 | Streit | 5/18.1 |
| 547,126 | A | * | 10/1895 | Noyes | 5/18.1 X |
| 597,071 | A | * | 1/1898 | Sigurdson | 5/37.1 |
| 748,847 | A | * | 1/1904 | de Vault | 5/18.1 X |
| 2,223,261 | A | * | 11/1940 | Mende | 5/41 X |
| 2,619,656 | A | * | 12/1952 | Crahan | 5/18.1 |
| 3,450,072 | A | * | 6/1969 | Farkas | 5/18.1 X |
| 3,634,893 | A | | 1/1972 | Hern et al. | 5/37.1 |
| 4,538,308 | A | | 9/1985 | Grigoriev | 5/42.1 |
| 4,642,823 | A | | 2/1987 | Wiggins | 5/47 |
| 4,829,611 | A | | 5/1989 | Fireman et al. | 5/47 |
| 4,875,244 | A | | 10/1989 | Tremblay | 5/37.1 |
| 4,996,730 | A | | 3/1991 | Fireman et al. | 5/37.1 |
| 5,146,640 | A | | 9/1992 | Barton et al. | 5/47 |
| 5,153,952 | A | | 10/1992 | Barton et al. | 5/47 |
| 5,303,432 | A | | 4/1994 | Fitts | 5/37.1 |
| 5,315,722 | A | | 5/1994 | Djie | 5/37.1 |
| 5,327,591 | A | | 7/1994 | Fireman et al. | 5/47 |
| 5,509,151 | A | | 4/1996 | Fireman et al. | 5/37.1 |
| 5,513,398 | A | | 5/1996 | Dodge | 5/37.1 |
| 5,519,902 | A | | 5/1996 | Meade | 5/38 |
| 5,628,076 | A | | 5/1997 | Newton | 5/37.1 |
| 5,664,268 | A | | 9/1997 | Stoler et al. | 5/37.1 |
| 5,722,101 | A | | 3/1998 | Grigoriev | 5/37.1 |
| 5,790,993 | A | | 8/1998 | Roma et al. | 5/37.1 |
| 5,815,858 | A | | 10/1998 | Dodge | 5/37.1 |
| 6,135,545 | A | * | 10/2000 | Liao | 5/18.1 X |

FOREIGN PATENT DOCUMENTS

| | | | | |
|---|---|---|---|---|
| DE | 806709 | * | 6/1951 | 5/18.1 |
| DE | 812817 | * | 9/1951 | 5/18.1 |
| DE | 240130 | * | 10/1986 | 5/18.1 |
| FR | 635701 | * | 3/1928 | 5/18.1 |
| GB | 469200 | * | 7/1937 | 5/37.1 |

* cited by examiner

*Primary Examiner*—Robert G. Santos
(74) *Attorney, Agent, or Firm*—Dicke, Billig & Czaja, P.A.

(57) ABSTRACT

Furniture frames, such as futon frames, are movable between bed configurations and sofa configurations. Furniture frame embodiments according to the invention provide a more level, continuous and secure sleep surface than currently available. The central gap present in many futon frames, for example, is eliminated, as is a fourth cross rail. Manufacturing costs are reduced, and reliability is improved. Additionally, furniture frame embodiments include at least one topple member that engages the top of a depending backrest side or side and does not put pressure on a hole accommodating a pivot pin connecting the backrest panel and seat panel. Mechanical advantage is improved. Further, a working end of the depending backrest side can be produced with a single cut, eliminating the need for multiple cuts and/or attachment of separate pieces, thereby lowering manufacturing costs. Corresponding methods provide similar advantages.

15 Claims, 12 Drawing Sheets

FURNITURE DEVICES AND METHODS

CROSS-REFERENCE TO RELATED APPLICATIONS

The subject matter of this application is related to the subject matter of U.S. patent application Ser. No. 60/134,720, filed May 18, 1999, and 60/147,305, filed Aug. 5, 1999, priority to both of which is claimed under 35 U.S.C. § 119(e) and both of which are incorporated herein by reference.

BACKGROUND OF THE INVENTION

1. Field of the Invention

The invention relates to furniture, and more particularly to furniture frames, such as futon frames, that are movable between sofa and bed configurations.

2. Description of Related Art

The futon industry is enjoying tremendous growth across the United States and elsewhere. Futons, futon frames, and similar convertible furniture products are offered in a wealth of styles and options, offering multi-use functionality and practicality at a reasonable price. As with any growing industry, a producer that can improve the reliability, durability, and attractiveness of its products, make its products more comfortable and easier to use, and reduce its own manufacturing costs and complexity, stands to reap a substantial reward. The futon industry is no exception. Embodiments of the invention provide these advantages and offer significant improvements over the prior art.

FIGS. 1–3 show conventional futon frame 10. Substantially rectangular pivoting member 15, which can also be bell-shaped, is pivotally coupled to and hangs down from seat panel 20. Pivoting member 15 engages kicker attachment 25 to backrest panel 30. Kicker attachment 25 defines substantially L-shaped notch 35. As shown in FIG. 2, pivoting member 15 engages kicker attachment 25 at L-shaped notch 35 to lift backrest 30 to the sofa configuration of FIG. 1. Ultimately, futon frame 10 can be returned to a bed configuration like that shown in FIG. 3.

Embodiments of the present invention offer improvements over futon frames like those shown in FIGS. 1–3. Creating L-shaped notch 35 in kicker attachment 25 is quite labor-intensive, and thus expensive. Moreover, kicker attachment 25 is quite prone to breakage, e.g. along the grain and/or along a line extending through pivot pin 40, which connects backrest 30 and seat panel 20. Substantial stress is also exerted on pivoting member 15, especially at the point of its pivotal connection to seat panel 20. It can also be difficult to tell when pivoting member 15 has moved to a position of proper engagement with kicker attachment 25.

Aside from these mechanical issues, futon frame 10 also presents a disadvantage in that a substantial gap 45 is created between seat panel 20 and backrest panel 30 when futon frame 10 is in the bed configuration of FIG. 3. Gap 45 typically is 2–3 inches wide and can create unevenness in a futon or pad placed over frame 10. An uneven sleep surface causes general discomfort, especially for a single user of the futon in the bed configuration. Another problem arises in that gap 45 is bordered by two cross rails 50, which run entirely across the length of frame 10. Unless precisely aligned, each cross rail 50 can create a ridge or other uneven surface with respect to slats 55. This ridge-gap-ridge profile down the center of frame 10 adds to the discomfort potentially experienced by a user of frame 10.

Finally, frame 10 includes not only cross rails 50 but also two additional cross rails 60, for a total of four cross rails. These long boards are relatively expensive, increasing manufacturing costs. Further, the cross rail 50 at the back of seat panel 20 tends to break, e.g. when a user sits down hard or jumps on frame 10 in its sofa configuration. Therefore, a number of such futon frames include one or more additional short support boards to reinforce the long boards, which again increase labor and material costs.

A number of prior art futon designs are illustrated and described in e.g. U.S. Pat. Nos. 3,634,893, 4,538,308, 4,642,823, 4,829,611, 4,875,244, 4,996,730, 5,146,640, 5,153,952, 5,303,432, 5,315,722, 5,327,591, 5,509,151, 5,513,398, 5,519,902, 5,628,076, 5,664,268, 5,722,101, 5,790,993, 5,815,858, all of which are incorporated by reference herein.

SUMMARY OF THE INVENTION

Embodiments of the invention overcome the above and/or other disadvantages. Embodiments of the invention reduce labor, material and other furniture manufacturing costs, improve comfort for the user of furniture items, increase reliability and longevity of furniture items, and provide other advantages.

More specifically, for example, a topple member according to an embodiment of the invention engages the top of a depending backrest side and does not put pressure on a hole accommodating a pivot pin connecting the backrest panel and seat panel. Further, a working end of the depending backrest side can be produced with a single cut, eliminating the need for multiple cuts and/or attachment of separate pieces, thereby lowering manufacturing costs. The depending backrest side according to embodiments of the invention increases the lever arm between the pivot pin and the point of engagement with the topple member, providing greater torque and decreasing the amount of pushing force the operator is required to exert.

Additionally, embodiments of the invention provide a more level, continuous and secure sleep surface than available with many current futon frames. The central gap present in many futon frames, for example, is eliminated. Manufacturing costs are reduced, and reliability is improved.

Certain embodiments described and illustrated herein are "wall-hugging" embodiments, that is, the backrest panel can be placed substantially against a wall when the furniture frame is in the sofa configuration, and remain against the wall even when the furniture frame is shifted to a bed configuration. Further, a user can change the frame from the bed configuration to the sofa configuration and vice versa solely from the front of the frame.

Other advantages and features according to the invention will be apparent to those of ordinary skill upon reading this application.

BRIEF DESCRIPTION OF THE DRAWINGS

Embodiments of the invention will be described with respect to the figures, in which like reference numbers denote like elements and in which.

DETAILED DESCRIPTION OF PREFERRED EMBODIMENTS

Embodiments of the invention and associated operational steps first will be described together with respect to FIGS. 4–14. More specifically, a topple member feature for a futon or similar piece of furniture will first be described. Topple members according to embodiments of the invention allow a user to easily operate a futon frame or other furniture frame from the front, e.g. to move the frame between a bed configuration and a sofa configuration. The topple members are sturdy and reliable, providing leveraged mechanical advantage in a manner believed heretofore unknown in the prior art.

Figure 4:
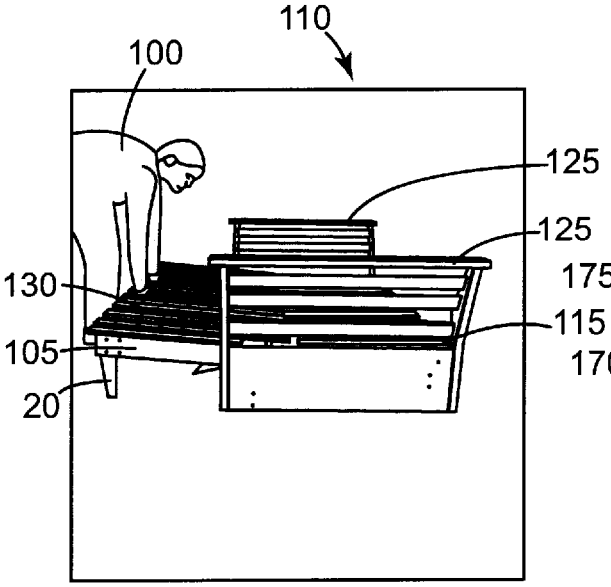
FIG. 4 is a perspective view of a futon frame according to an embodiment of the invention.

As shown in e.g. FIG. 4, user 100 picks up a forward portion 105 of futon frame 110, also called a seat panel, when frame 110 is in a bed configuration. In the bed configuration, seat panel 105 and back portion 115, also called a backrest panel, together are in a generally horizontal plane. Forward leg 120 of frame 110 engages the floor or other underlying support, and seat panel 105 and backrest panel 115 together present a generally flat surface for supporting a futon, mattress, cushion or the like.

Figure 22:
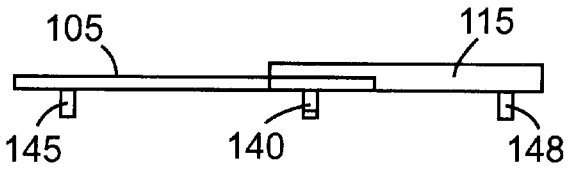
FIG. 22 is a side schematic view of a futon frame according to an embodiment of the invention.

Further structural details according to embodiments of the invention are visible in e.g. FIGS. 4–7. Futon frame 110 includes arms 125, as shown. Seat panel 105 includes a plurality of slats 130 extending in a transverse direction of frame 110, and backrest panel 115 includes a plurality of slats 135 also extending in a transverse direction. Frame 110 also includes longitudinal cross member 140, also called a bottom back rail, which contacts and supports both the transverse slats 130 of seat panel 105 and the transverse slats 135 of backrest panel 115. As will be described later, e.g. with respect to FIGS. 22–23, frame 110 also includes two additional longitudinal cross members: front seat rail 145 and top back rail 148.

Figure 5:
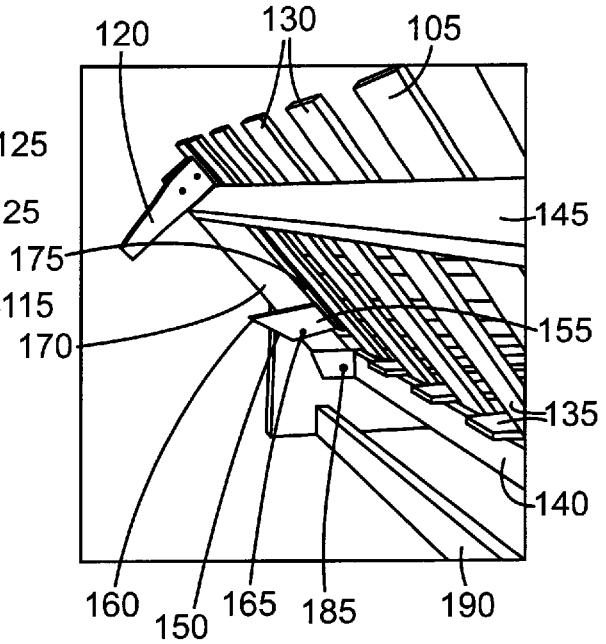
FIGS. 5–14 are perspective views of the FIG. 4 futon frame in alternative configurations.
Figure 6:
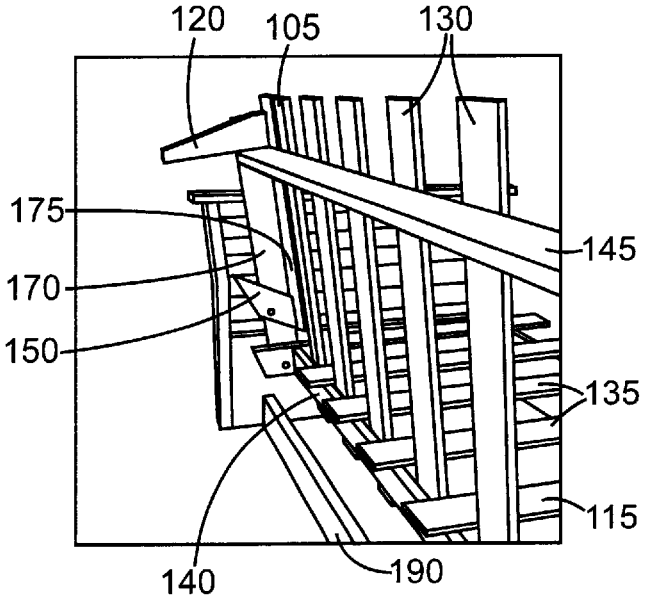

Seat panel 105 is lifted from the position of FIG. 4 to and through the positions of FIGS. 5–6, as shown, to begin the process of moving furniture frame 100 from the bed configuration to a sofa configuration. In the sofa configuration, as will be recognized by those of ordinary skill, seat panel 105 and backrest panel 115 are disposed at an angle to each other.

Topple member 150 for the illustrated futon frame 110 is visible in e.g. FIGS. 5–6, substantially in the shape of a trapezoid according to this particular embodiment. Topple member 150 defines a relatively shorter first end or "nose" portion 155, shown in FIG. 5 as the rightmost portion of topple member 150. Topple member 150 also defines a relatively longer second end or "tail" portion 160, shown in FIG. 5 as the leftmost portion. Although a single topple member is also contemplated according to the invention, the embodiment of the figures includes two substantially identical topple members 150: one at the near end of futon frame 110 as viewed in e.g. FIG. 4, and one at the far end. To simplify the disclosure, only one of the two topple members 150 generally will be referenced herein.

Topple member 150 is pivotally connected to seat panel 105 at pivot pin 165 disposed between first end 155 and second end 160. As will be apparent from FIG. 5, the center of gravity of topple member 150 is disposed above pivot pin 165, for reasons to be explained.

Pivot pin 165 extends through a corresponding hole in topple member 150 and is anchored into seat side 170 at a side of seat panel 105, as shown. The center of gravity of topple member 150 is constructed to be above and to the left of pivot pin 165 in e.g. the configuration of FIGS. 5–6. Further, pivot pin 165 is disposed substantially below a line extending from the lower left corner to the upper right corner of topple member 150 as viewed in FIG. 5.

In FIGS. 5–6, first end or nose 155 of topple member 150 engages engagement slat 175 of seat panel 105. Engagement slat 175 extends generally parallel to remaining slats 130 of seat panel 105 and to slats 135 of backrest panel 115 when futon frame 110 is in the bed configuration, according to this embodiment. Engagement slat 175 can be substantially shorter than the other slats, e.g. extending just far enough to engage nose 155 and tail 160 of topple member 150, or can be generally the same length as the other slats. According to still further embodiments, engagement slat 175 can be eliminated altogether, as will be described.

Figure 7:
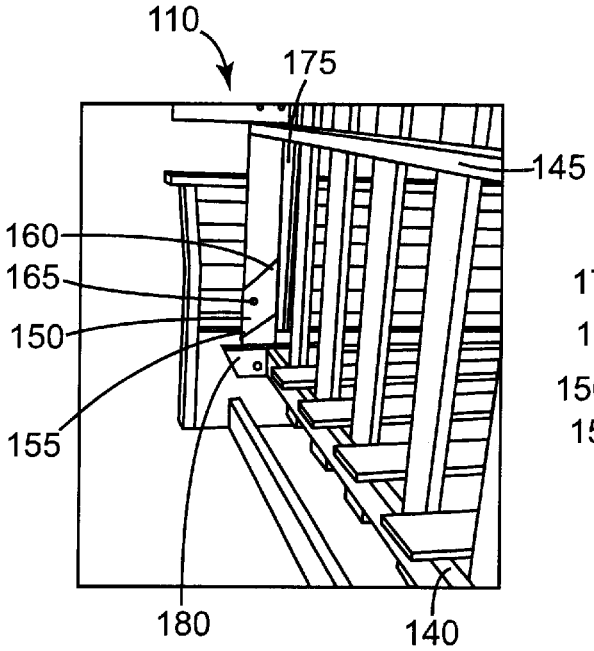

As user 100 continues to lift seat panel 105 from e.g. the FIG. 6 position, the center of gravity of topple member 150 shifts from the left of pivot 165 to the right of pivot 165, as viewed in the figure. This shift in the center of gravity rotates or topples topple member 150 over, until tail portion 160 thereof hits engagement slat 175, as shown in FIG. 7. At this point seat panel 105 is ready to be lowered, to engage backrest side 180 and elevate backrest panel 115, as will be described.

When tail 160 of topple member 150 hits engagement slat 175, an audible "clicking" or other sound is made. When two topple members 150 on opposite sides of frame 110 are provided and hit their respective engagement slats, an aesthetically pleasing "click-click" sound can be heard, reassuring the user that proper engagement has occurred. The exact character of the sound will depend on the materials from which e.g. each topple member 150 and engagement slat 175 are constructed. Wooden materials will result in a softer and more natural sound than e.g. metal, plastic, or other materials, but such other materials are fully contemplated by the invention. According to an additional embodiment, topple member 150 can be in the form of a bell, or otherwise have a clapper or ringing device to present an additional or different sound audible to the user.

According to other embodiments of the invention, a contact pad can be provided at tail 160 of topple member 150 and/or at a corresponding location on engagement slat 175. The contact pad can be constructed of a material to provide a desired sound characteristic when topple member 150 comes into contact with the engagement slat 175, and can be shaped to cover e.g. all or a portion of the edge of topple member 150 facing engagement slat 175. Dual contact pads of different materials can be provided on opposite topple members 150, to provide different sound qualities—e.g. a "click-clack" or "clack-click" sound, depending on which topple member 150 engages its corresponding engagement slat 175 first. Alternatively, one topple member 150 can have a contact pad and the other not. Of course, topple member 150 and/or engagement slat 175 also can be provided with cloth, padding or other material to soften or mute the sound of engagement, if desired.

Although substantially simultaneous engagement of topple members 150 with their respective engagement slats 175 will result in substantially a single sound, normally there will be a slight separation in the sounds. If desired, the structural (e.g. center-of-gravity) characteristics of e.g. one or both topple members 150 can be altered, to promote non-simultaneous engagement, as will be described below with respect to FIGS. 15–18.

The sound made by one or more topple members 150 alerts user 100 that nose 155 of topple member 150 is in position to engage back side or backrest side 180 depending from the side of backrest panel 115, as shown in e.g. FIG. 7. As user 100 then lowers seat panel 105 toward the floor, nose 155 engages and pushes down on depending backrest side 180, as shown in e.g. FIGS. 8–9. As with previously described engagement slats 175, two depending backrest sides 180 can be provided, one on each side of futon or other furniture frame 110, i.e. one for each topple member 150.

Figure 8:
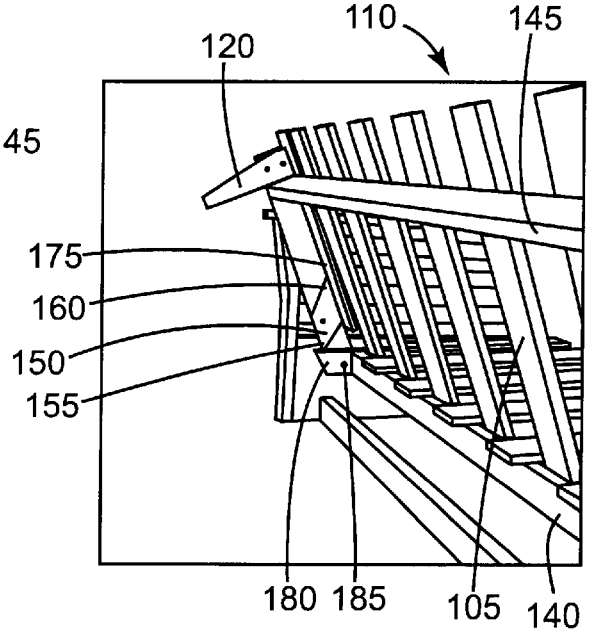

In FIG. 7, as previously described, topple member 150 has toppled. In other words, the center of gravity of topple member 150 has shifted from the left of pivot pin 165, as viewed in the figure, to the right thereof. In FIG. 8, user 100 has lowered seat panel 105 until nose 155 of topple member 150 has engaged depending backrest side 180. In this position, as shown, depending backrest side 180 supports seat panel 105 in a raised position without operator support, via topple member 150 and engagement slat 175.

Figure 9:
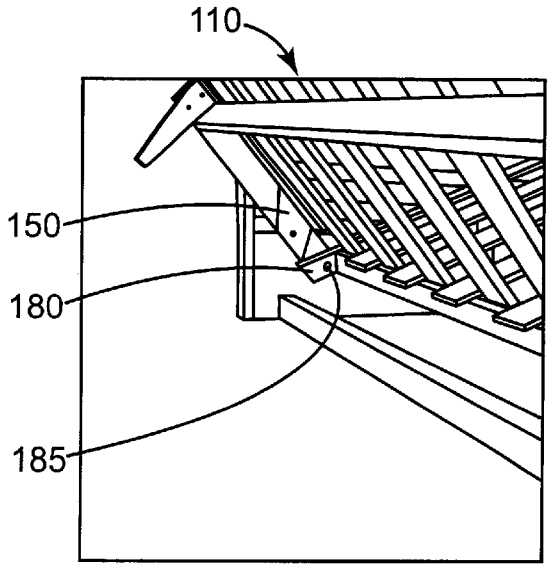
Figure 10:
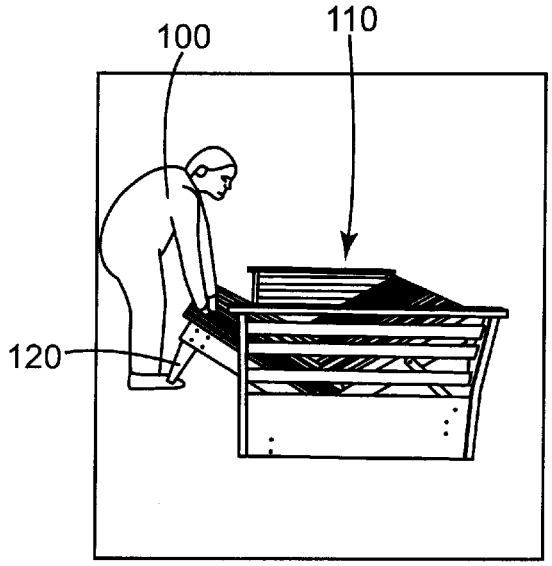

In FIG. 9, user 100 exerts downward pressure on seat panel 105, providing mechanical advantage to lever backrest panel 115 into a more upright position, via engagement slat 175, topple member 150 and depending backrest side 180. Ultimately, as shown in e.g. FIGS. 10–13, futon frame 110 achieves a sofa configuration, with forward leg 120 again engaging the floor to support seat panel 105.

Figure 1:
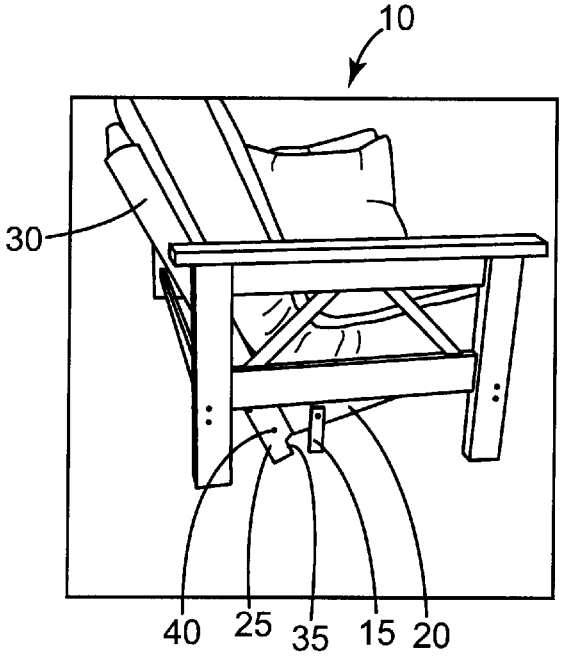
Fig. 1 Prior Art
FIG. 1 is a perspective view of a typical futon frame in a sofa configuration.
Figure 2:
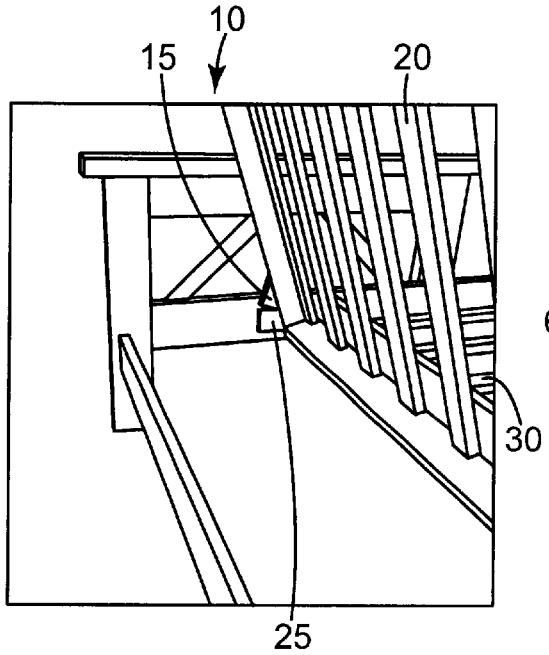
Fig. 2 Prior Art
FIG. 2 is an alternative perspective view of the FIG. 1 frame in a transitional configuration.
Figure 3:
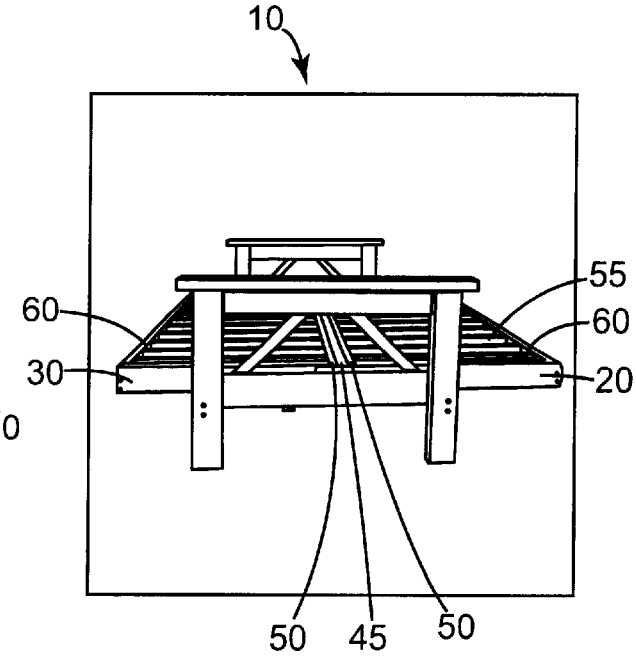
Fig. 3 Prior Art
FIG. 3 is an alternative perspective view of the FIG. 1 frame in a bed configuration.

Depending backrest side 180 is specifically constructed for strength and durability. As shown in e.g. FIGS. 7–8, depending backrest side 180 is preferably of one-piece construction and is tapered such that nose 155 of topple member 150 engages a top portion thereof. In contrast, as referenced above, the prior art mechanism of e.g. FIG. 1 includes substantially rectangular pivoting member 15 that hangs down from seat panel 20 for engagement with kicker attachment 25. Kicker attachment 25 includes a substantially L-shaped cutout 35 for engagement with pivoting member 15, whereas depending backrest side 180 according to the invention is free of this cutout portion. Notched kicker attachment 25 is quite labor-intensive (and thus expensive) to make, and is quite prone to breakage e.g. along the grain and/or e.g. along a line extending through the pivot pin connecting the backrest and seat panel.

Frame 110 and topple member 150 according to embodiments of the invention overcome these problems of the prior art. Topple member 150 engages the top of depending backrest side 180 and does not put significant pressure on the hole accommodating pivot pin 165, or on the pivotal connection 185 between seat panel 105 and backrest panel 115. In other words, at least pivot pin 165 is generally non-load-bearing. Further, the working end of depending backrest side 180 can be produced with a single cut, eliminating the need for multiple cuts and/or attachment of separate pieces and the associated manufacturing costs. Depending backrest side 180 according to the invention increases the lever arm between pivotal connection 185 and the point of engagement with topple member 150, providing greater torque and decreasing the amount of pushing force the operator is required to exert.

Figure 11:
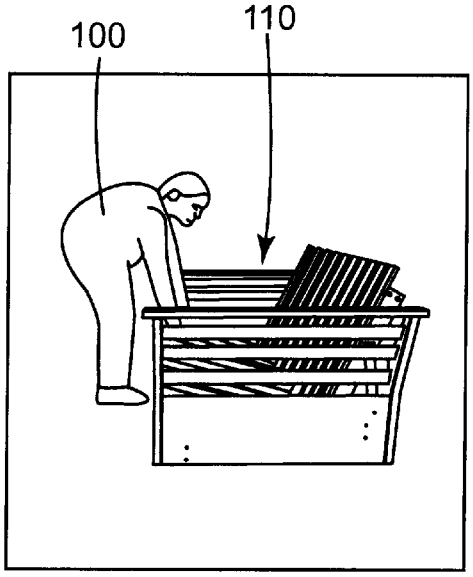
Figure 12:
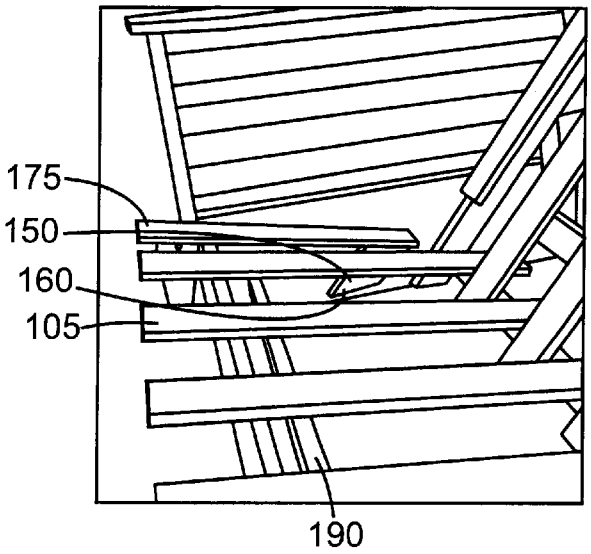
Figure 13:
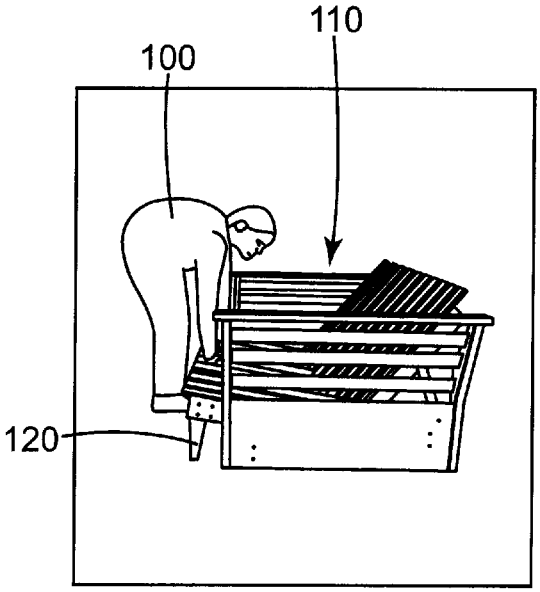

In FIG. 11, seat panel 105 is now pushed in, toward backrest panel 115, to release topple member 150. As shown in FIG. 12, topple member 150 then becomes disengaged, toppling back out of the way. Seat panel 105 then can be pulled out, if desired, as shown in e.g. FIG. 13, causing futon frame 110 to enter a "lounge" or partially reclined configuration. Topple member 150 causes frame 110 to stop in the lounge position, when hanging tail 160 of topple member 150 engages front rail 190 extending between and connecting the two arm panels 125 of futon frame 110. Front rail 190 is shown in e.g. FIGS. 6 and 12, and FIG. 12 additionally shows tail 160 of topple member 150 poised to engage front rail 190 once seat panel 105 is pulled out in the manner of FIG. 13.

Figure 14:
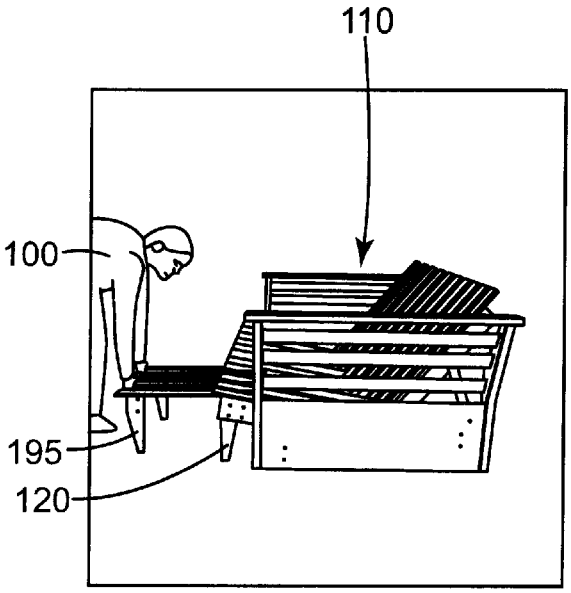

As shown in e.g. FIG. 14, embodiments of the invention also include footrest 195, which can be pulled out if desired. FIG. 14 also shows the newly configured futon frame 110 in a ready-to-use, sofa configuration. To move futon frame 110 back to the bed configuration, user 100 lifts seat panel 105 until topple member 150 clears front rail 190, and then pulls seat panel 105 out until it and backrest panel 115 move into a generally horizontal position.

Figure 14A:
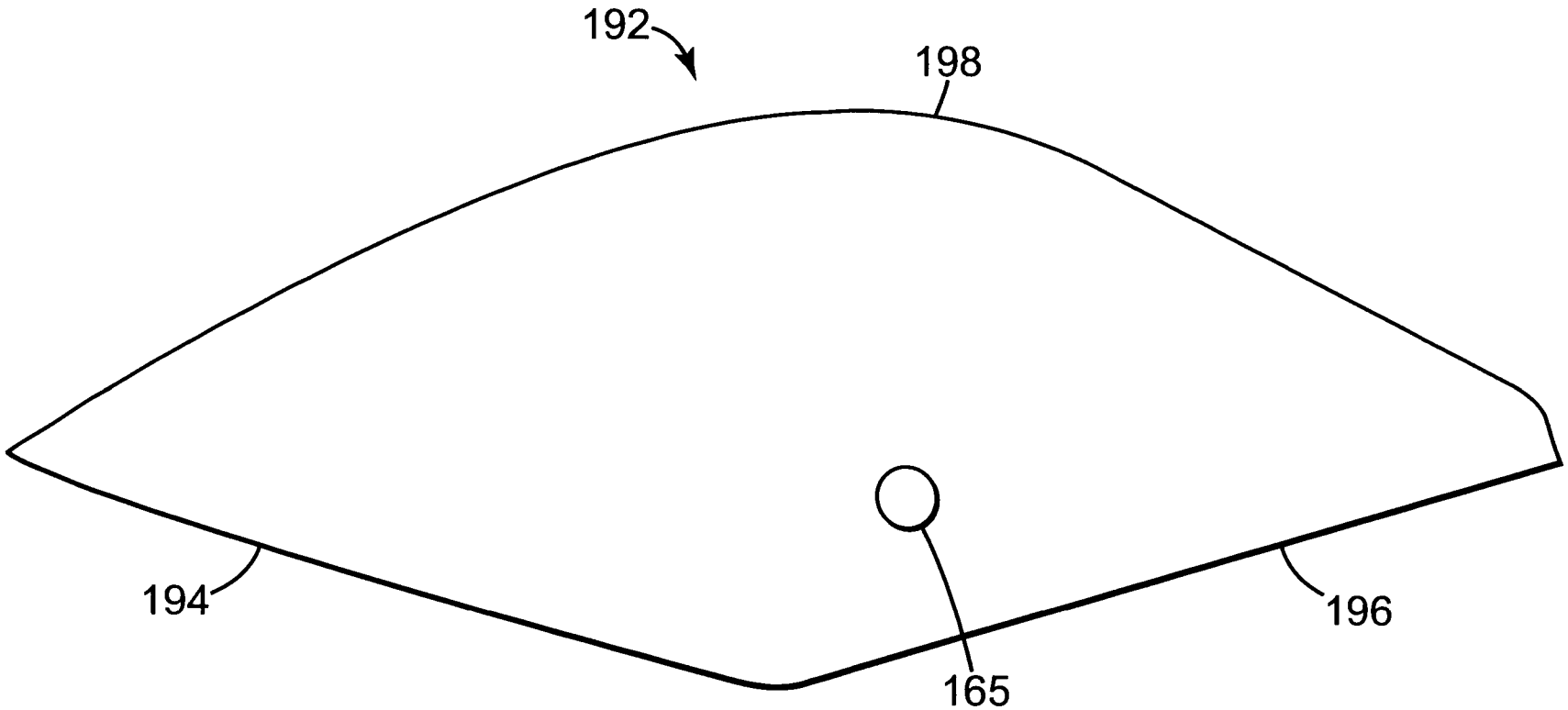
FIG. 14A is a side view of a topple member according to an embodiment of the invention.

Although topple member 150 illustrated in e.g. FIGS. 5–6 is generally in the shape of a trapezoid, other shapes are fully contemplated according to the invention. For example, topple member 150 can be generally in the shape of a parallelogram, triangle, or other geometric figure. FIG. 14A, for example, shows topple member 192 having two straight sides 194, 196, and curved side 198. In other words, topple member 192 defines an outline shape consisting of two straight edges and one curved edge. As shown in e.g. FIG. 15, alternative topple member 200 can comprise more than one geometric shape. In the illustrated example, topple member 200 includes triangular portion 205 rigidly affixed to or formed as one-piece with a relatively narrow elongated portion 210 that here is generally rectangular but can be of any desired shape. Opposite ends 215, 220 of the elongated portion 210 are functionally equivalent to nose 155 and tail 160 of topple member 150 illustrated and described previously.

Figure 15:
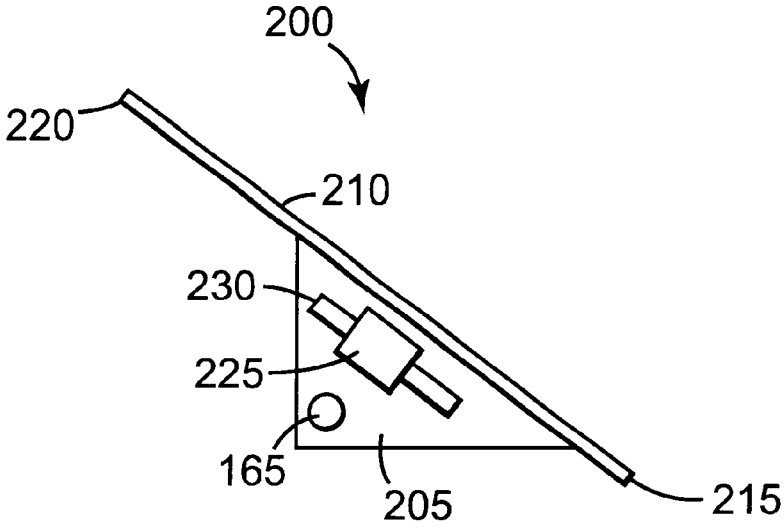
FIG. 15 is a side view of a topple member according to an embodiment of the invention.

FIG. 15 also illustrates a mechanism for shifting the center of gravity of topple member 200, according to an embodiment of the invention. Weight 225 is mounted to move along support rod 230, as shown. Movement of weight 225 along rod 230 can be accomplished in a number of ways. For example, weight 225 can be generally hollow and mounted with a friction fit on rod 230, or weight 225 and rod 230 can be threaded together such that rotation of weight 225 propels it along rod 230, or weight 225 can be cantilevered off rod 230. Other ways to shift the center of gravity of topple member 200 also can be provided and will be apparent to those of ordinary skill upon reading this description.

The FIG. 15 embodiment is contemplated primarily for use with metal topple members 200 and/or associated structure, but, of course, can be used with other materials as well. By providing structure that allows the center of gravity to be adjusted, each topple member 200 present in a single futon frame or other frame 110 can be "fine-tuned" to topple at just the right time to produce a desired auditory or other effect.

The center of gravity of a topple member according to the invention also can be altered by drilling or otherwise providing a hole through the topple member, reducing the weight of a certain area thereof. On the other hand, a lead or other weight can be inserted into the hole, increasing the weight of that area. Additionally, the overall shape of the topple member can be altered to provide desired center-of-gravity characteristics. For example, in addition to the generally triangular embodiments shown in FIG. 15, a generally triangular topple member can be created by forming a generally straight edge between the nose and the tail of topple member 150 shown in e.g. FIG. 5. A wide variety of shapes and other structure for modifying the center of gravity of the topple member are contemplated.

Figure 16:
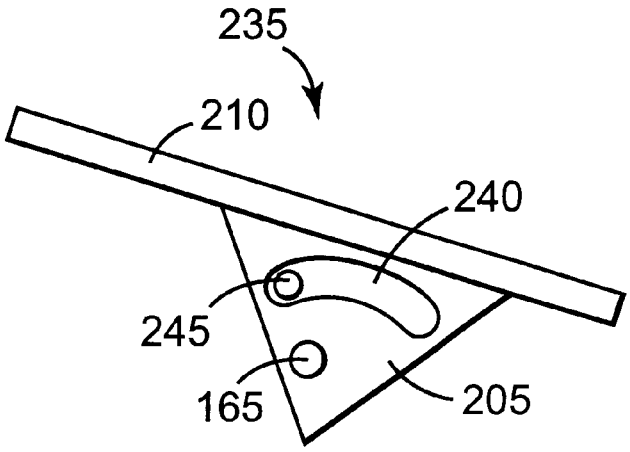
FIG. 16 is a side view of a topple member according to an embodiment of the invention.
Figure 17:
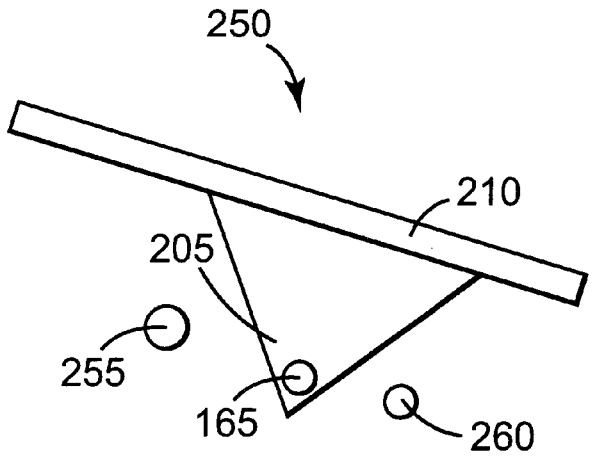
FIG. 17 is a side view of a topple member according to an embodiment of the invention.
Figure 18:
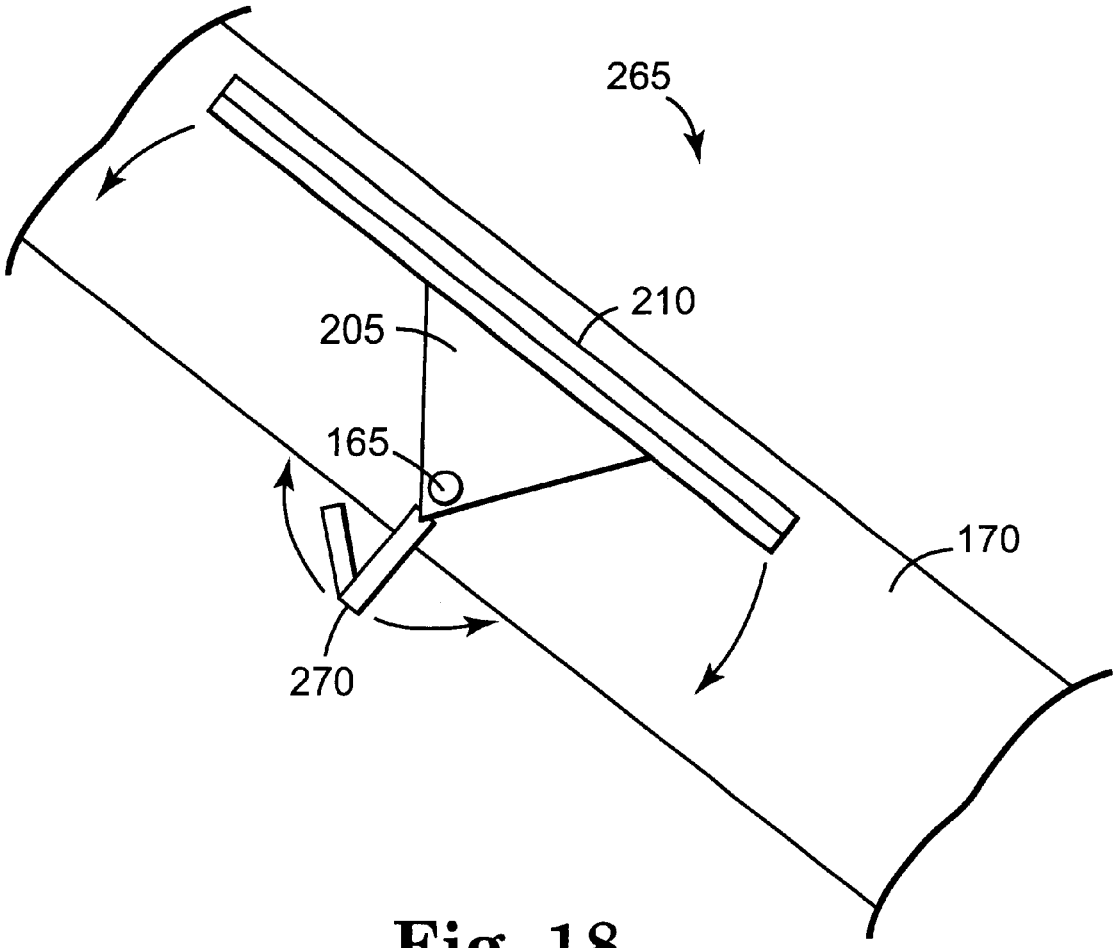
FIG. 18 is a side view of a topple member according to an embodiment of the invention.
Figure 19:
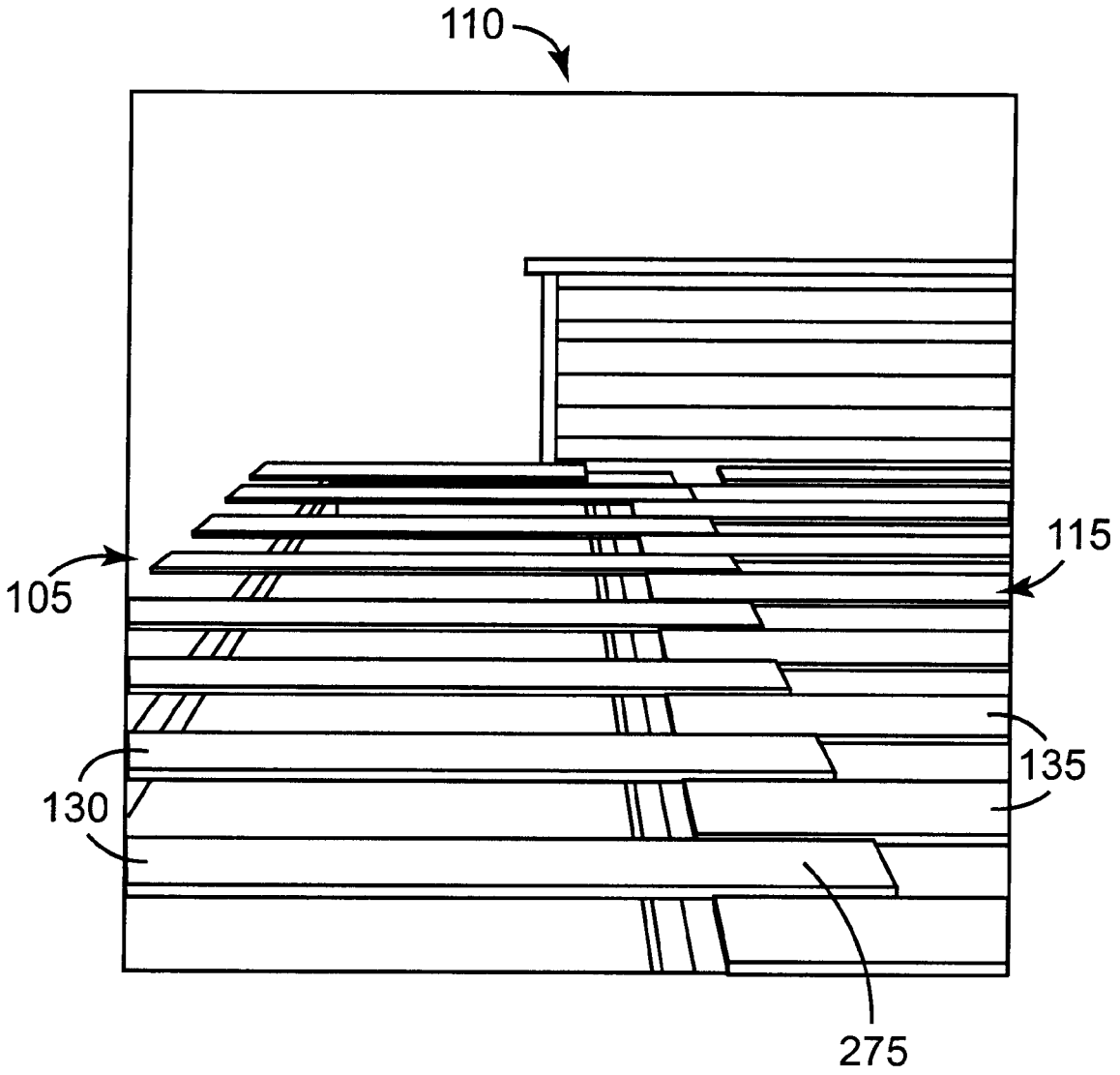
FIG. 19 is a perspective view of a futon frame according to an embodiment of the invention.

FIGS. 16–18 illustrate several additional structural aspects of topple members according to embodiments of the invention. Instead of or in addition to limiting topple-member pivot by the previously described engagement slat(s) 175 and/or depending backrest side(s) 180, the FIG. 16 embodiment provides slotted topple member 235. Slot 240 of member 235 accommodates pin 245, which is secured to e.g. seat side 170 along with topple member pivot pin 165. In the FIG. 17 embodiment, pivoting motion of topple member 250 is limited by engagement pins 255, 260. Pins 255, 260 protrude from e.g. seat side 170 for engaging sides of triangular portion 205 of topple member 250. In the FIG. 18 embodiment, topple member 265 includes depending L-shaped or other-shaped member 270, e.g. generally rigidly affixed with respect to the remainder of topple member 265, for hooking under or otherwise engaging e.g. seat side 170 and thereby limiting pivoting motion of topple member 265.

Additional embodiments of the invention provide an interlocking slat system for a sofa, futon or similar item of furniture. The system is engineered to eliminate at least one of the long slat supports (i.e. cross rails) present in many known furniture items, thereby reducing manufacturing costs, while at the same time increasing overall strength. Other advantages include providing a more comfortable sleeping or lying surface by eliminating the usual 2–3 inch gap running down the middle of many previous futon frames. A footrest also can be provided. These embodiments of the invention will now be described in more detail.

More specifically, turning now to FIGS. 19–23, an alternative futon frame 110 includes longitudinal cross member 140, as described earlier. Note e.g. FIG. 20. Longitudinal cross member 140 is a part of back panel 115, according to the illustrated embodiment, and contacts and supports both the transverse slats 130 of seat panel 105 and the transverse slats 135 of backrest panel 115. The arrangement of seat panel slats 130, backrest panel slats 135, longitudinal cross member 140 and the other illustrated structures allow slats 130, 135 to generally mesh with each other down the center of futon frame 110 in the bed configuration. This meshing or overlap is illustrated at e.g. 275 in FIGS. 19–20, and creates a generally continuous futon support surface down the center of frame 110, without a gap or ridge-gap-ridge profile present in prior art furniture items as described above. Only seat panel slats 130 and back panel slats 135 provide an underlying contact surface for the futon or cushion to be supported by frame 110.

As mentioned, embodiments of the invention use only three cross rails (bottom back rail 140, front seat rail 145, and top back rail 148) instead of four. Seat panel 105 includes only one (front seat rail 145), and backrest panel 115 includes only two (bottom back rail 140 and top back rail 148). The fourth cross rail present in many prior art frames is eliminated, providing the manufacturing and other advantages described previously.

Backrest panel slats 135 are each rigidly attached to both bottom back rail 140 and top back rail 148, e.g. by nails, screws, bolts or other fastners 280 (FIG. 20), providing a rigid and squared panel. Seat panel slats 130, on the other hand, are rigidly attached by fastners 280 only to front seat rail 145. In a manner believed unknown in the prior art, seat panel slats 130 "float" or roll/slide with respect to bottom back rail 140 and are not fastened thereto. As frame 110 is moved from the bed configuration shown in e.g. FIG. 20 to the sofa configuration shown in e.g. FIG 21, seat panel slats 130 float/roll on bottom back rail 140.

Figure 23:
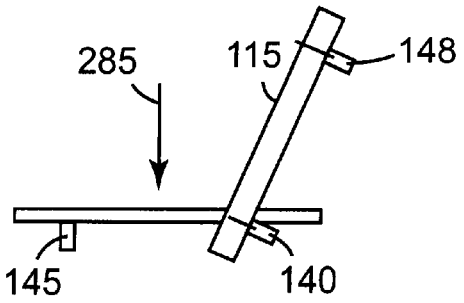
FIG. 23 is a side schematic view of the FIG. 22 frame in an alternative configuration.

Embodiments of the invention thus not only provide rigid triangulation strength, but also tie top backrest panel cross rail 148 to bottom backrest panel cross rail 140 via backrest panel slats 135, to give extra support when futon frame 110 is used as a sofa. Bending rigidity is increased, decreasing the likelihood of breakage under the stress of sitting pressure 285 (FIG. 23).

Figure 20:
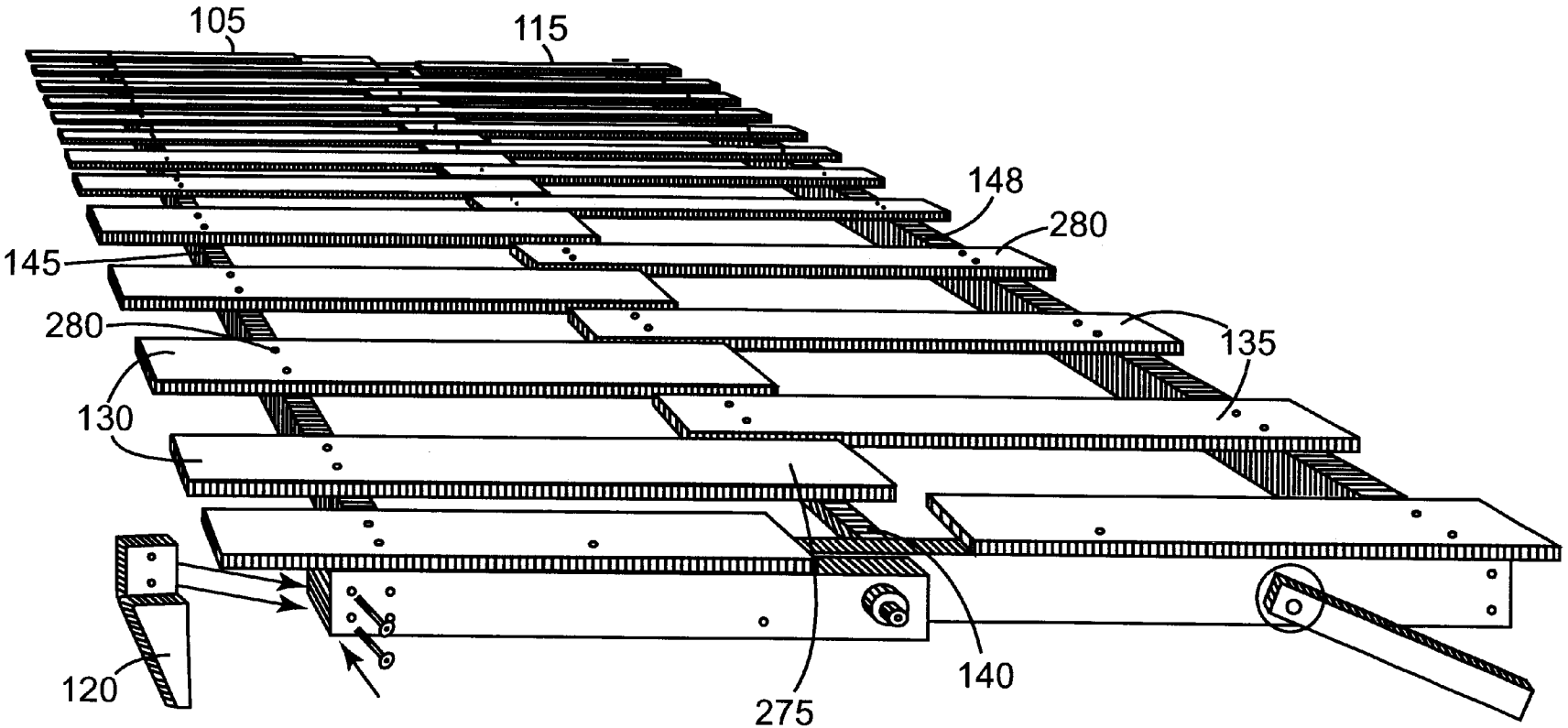
FIG. 20 is a perspective view of a futon frame according to an embodiment of the invention.
Figure 21:
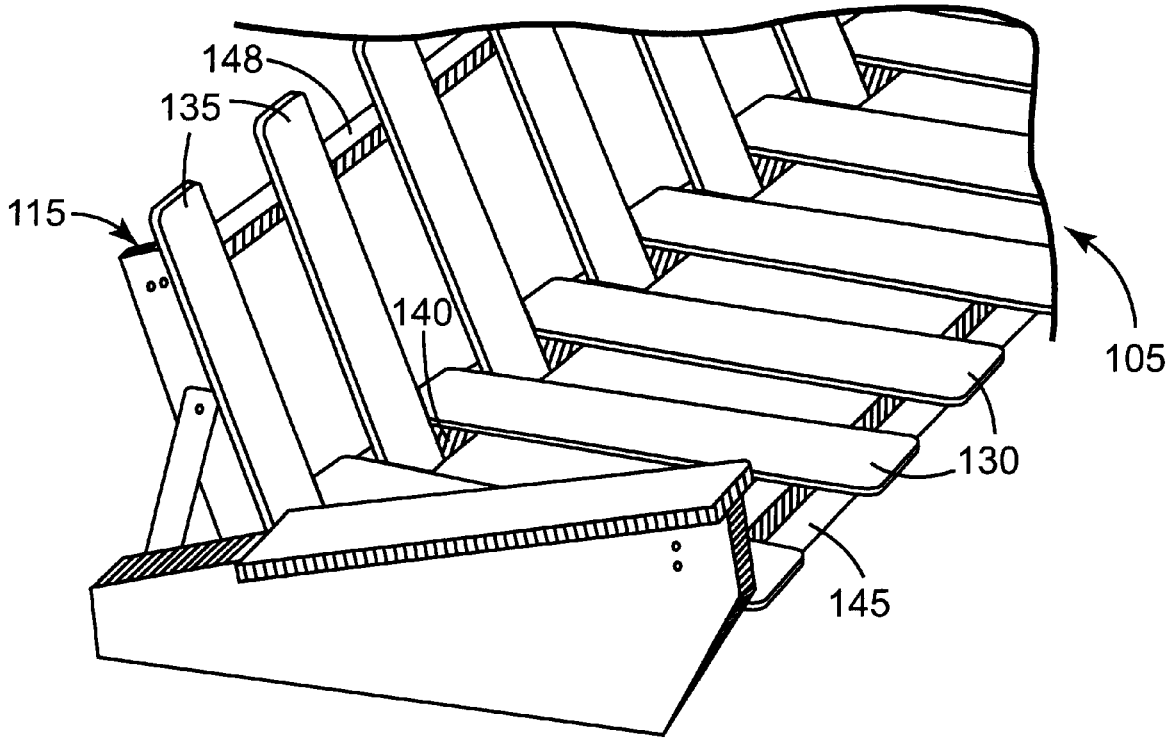
FIG. 21 is a perspective view of a futon frame according to an embodiment of the invention.
Figure 24:
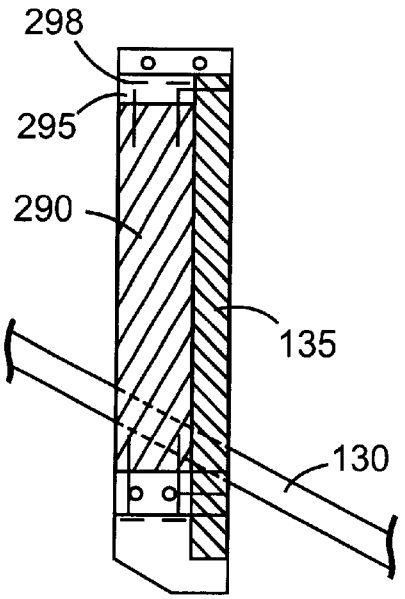
FIG. 24 is a side view of an alternative slat fastening arrangement according to an embodiment of the invention.

Instead of fastening back panel slats 135 to cross rails 140, 148 with fasteners 280, as shown in FIG. 20, FIG. 24 is a side view showing an alternative construction. According to this embodiment, each backrest panel slat 135 is positioned relative to seat panel slats 130 with backrest panel cross rail support 290, nailer 295, and nails 298, as shown. The FIG. 24 embodiment provides a flush top to backrest panel 115, instead of the "picket-fence" top shown in e.g. FIG. 21.

Figure 25:
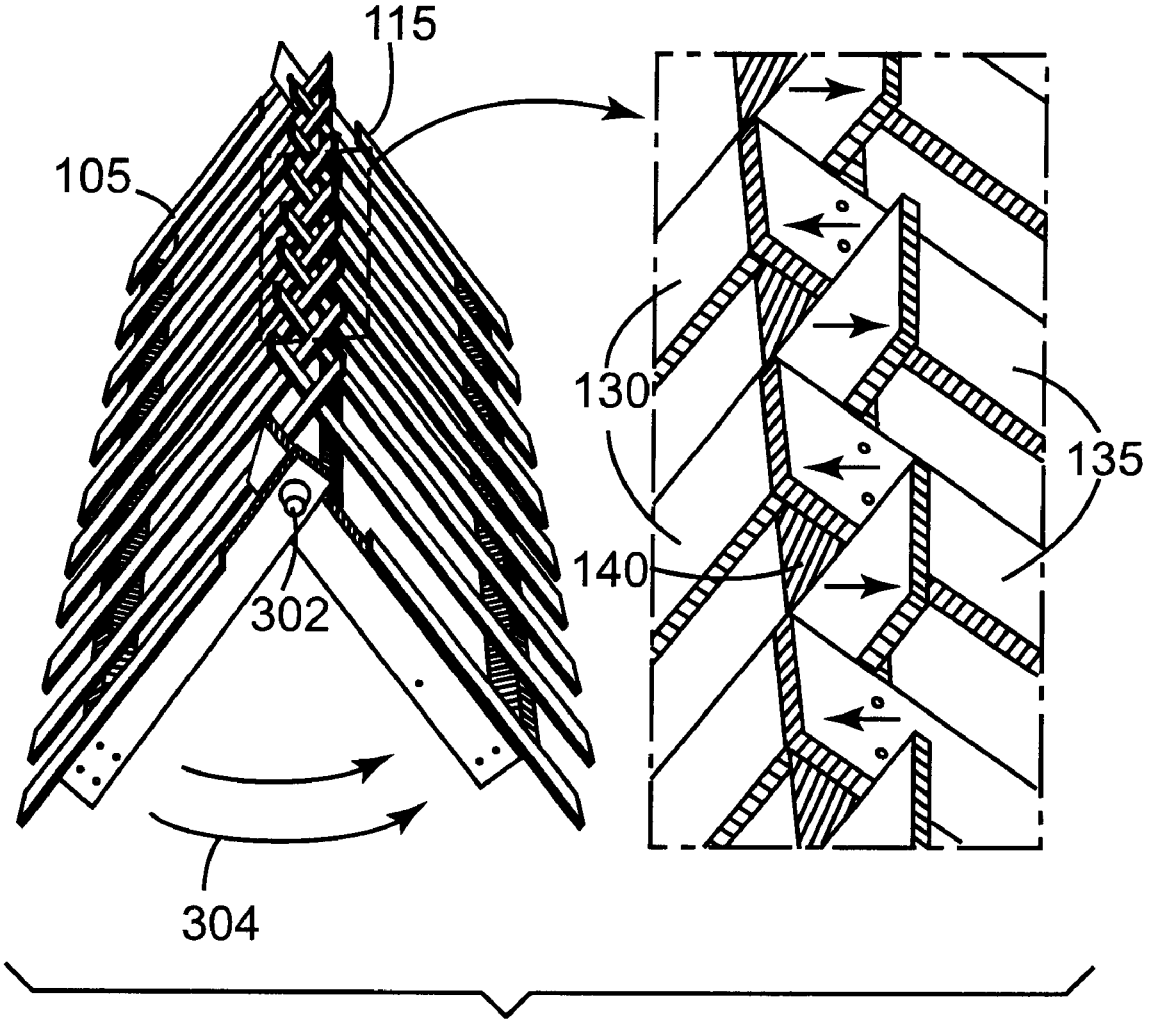
FIG. 25 is a perspective view of the FIG. 20 frame in a folded configuration.

Finally, as shown in FIG. 25, seat panel 105 and backrest panel 115 of an alternative futon frame can be shipped in a partially pre-assembled condition, connected by at least one pivot 302. As indicated by arrows 304, seat panel 105 and backrest panel 115 can be folded into a "doubled-over" configuration, with seat panel 105 and backrest panel 115 fitting or nesting into each other face-to-face. The alternate spacing of seat panel slats 130 and backrest panel slats 135 is especially advantageous in this regard, promoting a compact, easy-to-ship package. This design presents a number of advantages, including reduced shipping volume and cost, and improved structural soundness and integrity during the shipping process.

Thus, embodiments of the invention provide significant advantages over the prior art. Furniture frames according to embodiments of the invention are stronger, easier to make and use, more durable, and less costly than previously known. Other advantages will be apparent to those of ordinary skill.

Although the invention has been described herein with respect to particular embodiments, the invention is not intended to be limited to those specific embodiments. For example, although this specification specifically references futons, embodiments of the invention are equally applicable to sofas, beds, sofa-beds, chairs and other items of furniture intended for use in an upright configuration and/or a more prone or reclined configuration, and/or that are convertible between two configurations. Although the above description frequently has used the term "topple member," other terms can readily be used to describe the same item—e.g. pivot member, lever member, engagement member, locking element, to name a few. The topple member embodiments disclosed herein can be used with the interlocking slat embodiments, but any of the embodiments disclosed herein also can be used by themselves. Finally, the trademark BLUEBIRD is currently associated with the described topple member and associated products.

What is claimed is:

1. A furniture frame movable between a sofa configuration and a bed configuration, the furniture frame comprising:

a seat panel; and a back panel operably connected with the seat panel by connection structure;

wherein the seat panel and the back panel are movable relative to each other to form the bed configuration of the furniture frame, in which the seat panel and the back panel are in substantially the same generally horizontal plane to support a generally horizontal cushion, and to form the sofa configuration of the furniture frame, in which the seat panel and the back panel are disposed at an angle to each other;

further wherein a portion of the seat panel and a portion of the back panel overlap with each other to form a generally continuous cushion support surface down a center of the furniture frame when the furniture frame is in the bed configuration;

further wherein one of the seat panel and back panel comprises a longitudinal cross rail, further wherein the seat panel comprises seat panel slats and the back panel comprises back panel slats, further wherein either the seat panel slats or the back panel slats are constructed to roll on the longitudinal cross rail as the furniture frame moves between the bed configuration and the sofa configuration;

further wherein the connection structure comprises a pivotable member connected to the seat panel at a pivot point, the pivotable member being constructed to raise the back panel as the furniture frame moves from the bed configuration to the sofa configuration;

further wherein the pivotable member comprises a first end and a second end, the first end of the pivotable member being constructed to engage and lift the back panel when the furniture frame is being moved from the bed configuration to the sofa configuration, and the second end of the pivotable member being constructed to engage the seat panel, separately from the pivot, such that a downward force exerted on the seat panel exerts a lifting force on the back panel to move the furniture frame to the sofa configuration.

2. The furniture frame of claim 1, the back panel slats and the seat panel slats all being generally parallel to each other, only the back panel slats and the seat panel slats being constructed to provide an underlying contact surface for a cushion when the furniture frame is in the bed configuration.

3. The furniture frame of claim 1, wherein the back panel comprises an engagement member, the pivotable member being constructed to contact the engagement member at a portion of the engagement member free of a cutout.

4. A furniture frame movable between a sofa configuration and a bed configuration, the furniture frame comprising:

a seat portion; and a back portion operably connected with the seat portion by connection structure;

wherein the seat portion and the back portion are movable relative to each other to form the bed configuration of the furniture frame, in which the seat portion and the back portion are in substantially the same generally horizontal plane, and to form the sofa configuration of the furniture frame, in which the seat portion and the back portion are disposed at an angle to each other;

further wherein the connection structure comprises a topple member, the topple member comprising a first end and a second end, the topple member being pivotally connected to the seat portion at a pivotal connection between the first end and the second end;

further wherein the first end of the topple member is constructed to engage and lift the back portion when the furniture frame is being moved from the bed configuration to the sofa configuration, and the second end of the topple member is constructed to engage the seat portion, separately from the pivotal connection between the topple member and the seat portion, such that a downward force exerted on the seat portion exerts a lifting force on the back portion to move the furniture frame to the sofa configuration.

5. The furniture frame of claim 4 constructed such that lifting the seat portion when the furniture frame is in the bed configuration causes the second end of the topple member to come into engagement with the seat portion, separately from the pivotal connection, and thereby create a sound audible to a user of the furniture frame.

6. The furniture frame of claim 5, wherein the topple member is a first topple member, the furniture frame further comprising a second topple member on an opposite side of the furniture frame from the first topple member, the furniture frame being constructed such that lifting the seat portion when the furniture frame is in the bed configuration causes the first and second topple members to come into engagement with the seat portion and thereby create two sounds audible to a user of the furniture frame.

7. The furniture frame of claim 4, wherein the second end of the topple member is constructed to engage a slat of the seat portion.

8. The furniture frame of claim 4, wherein the topple member defines an outline shape consisting of two straight edges and one curved edge.

9. The furniture frame of claim 4, wherein the center of gravity of the topple member is above the pivotal connection.

10. A method of moving a furniture frame, having a seat portion and a back portion, between a bed configuration and a sofa configuration, the seat portion and the back portion being in substantially the same generally horizontal plane in the bed configuration, the seat portion and the back portion being disposed at an angle to each other in the sofa configuration, the method comprising:

providing a topple member, the topple member comprising a first end and a second end, the topple member being pivotally connected to the seat portion at a pivotal connection between the first end and the second end;

engaging the seat portion with second end of the topple member, separately from the pivotal connection between the topple member and the seat portion;

exerting a downward force on the seat portion; and exerting a lifting force on the back portion with the topple member to move the furniture frame to the sofa configuration.

11. The method of claim 10, further comprising:

lifting the seat portion when the furniture frame is in the bed configuration, said lifting causing the second end of the topple member to engage the seat portion with a sound audible to a user of the furniture frame.

12. The method of claim 11, further comprising adjusting the sound to the liking of the user.

13. The method of claim 11, further comprising:

providing a second topple member; and causing the two topple members to engage the seat portion with two sounds audible to a user of the furniture frame.

14. The method of claim 10, further comprising adjusting the center of gravity of the topple member to change the manner in which it pivots about the pivotal connection.

15. The method of claim 10, further comprising shipping the furniture frame in a pre-assembled condition, with at least the seat portion and the back portion pivotally connected and nested into each other face-to-face.

* * * * *